US005658200A

United States Patent [19]

Ellis

[11] Patent Number: 5,658,200

[45] Date of Patent: Aug. 19, 1997

[54] EVENT HORIZON

[76] Inventor: David G. Ellis, 176 E. Ave. L, Calimesa, Calif. 92320

[21] Appl. No.: 529,596

[22] Filed: Sep. 18, 1995

[51] Int. Cl.[6] ..... A63G 1/10; A63G 1/18

[52] U.S. Cl. ..... 472/2; 472/3; 472/18; 472/43

[58] Field of Search ..... 472/2, 3, 18, 19, 472/27, 29, 31, 33, 34, 43

[56] References Cited

U.S. PATENT DOCUMENTS

| | | | |
|---|---|---|---|
| 832,800 | 10/1906 | Mercer . | |
| 1,202,710 | 10/1916 | Harmeisten . | |
| 1,588,941 | 6/1926 | Chapman | 472/2 |
| 1,671,403 | 5/1928 | Brown . | |
| 1,890,353 | 12/1932 | Anderson . | |
| 1,903,116 | 3/1933 | Koschka | 472/2 |
| 3,083,081 | 3/1963 | Gregory . | |
| 4,973,042 | 11/1990 | Kloph . | |

*Primary Examiner*—Kien T. Nguyen

[57] ABSTRACT

A reversing Gravity Fed Orbital Ride "GFOR" (10) produces a repeating, descending and ascending orbital rotation, influenced by the tug of gravity. A plurality of variably inclining and declining paths, defined in a central column (12). A passenger carriage (14) supports seats (48) and guides (22), that interlock with the closed loop paths. Passengers are elevated to an Event Horizon (42) by rotating column (12), while simultaneously inhibiting the rotation of carriage (14). Passengers are driven along a descending orbital course, after reaching the Event Horizon. Thus, passengers can experience an intense centrifugal G-Force sensation and/or weightlessness. When maximum rotational velocity is obtained, a reverse in the vertical direction sends the passengers in an orbital ascent, that slows to a brief stop, reverses it's rotational direction and begins another descent. This repeats until built momentum is spent.

8 Claims, 6 Drawing Sheets

EVENT HORIZON

BACKGROUND—FIELD OF THE INVENTION

This invention relates to amusement rides, more specifically to gravity fed orbital amusement rides. Some amusement rides are designed intentionally to bring one to the height of excitement, while experiencing physical sensations such as an intense centrifugal G-Force and/or weightlessness.

BACKGROUND—DESCRIPTION OF THE PRIOR ART

Heretofore, a variety of amusement rides have been designed, where the influence of gravity is used to drive a passenger carriage, which is located rotatably about a central column, down a descending spiral course. These orbital rides have been given various names, such as "Playground Device", "Swing for Children", and "Tower Amusement Ride" etc . . . but most commonly referred to as "Roundabouts", all these rides have one thing in common, they are all Gravity Fed Orbital Rides, or "GFORS".

U.S. Pat. No. 1,671,403 to Brown, Roundabout (1928) and U.S. Pat. No. 3,083,081 to Gregory, Playground Device (1963) are two examples of GFORS, where the force of gravity and a descending spiral course is used, to direct a passenger carriage in a single orbital direction.

U.S. Pat. No. 1,202,710 to Hartmeister, Roundabout (1916) and U.S. Pat. No. 1,890,353 to Anderson, Swing for Children (1932) are two examples of GFORS, where the use of hand cranks is disclosed for manually placing the ride in the starting position. These single direction GFORS require a shock absorbing device to protect the passengers from the effects of gravity upon landing. Ladders are required to board these rides and passengers must risk the danger of falling, making these GFORS unsafe for public use.

U.S. Pat. No. 832,800 to Alfonce Mercer, Amusement Device (1906) and U.S. Pat. No. 4,973,042 to kloph et al. Tower Amusement Ride (1990), discloses the use of winches to elevate passengers vertically. Like all other GFORS having paths terminating at the extreme ends, continuous orbital travel in both rotational directions, using only gravity, is limited.

Previously, GFORS have suffered many drawbacks. They require manual rewind for placing the ride in the starting position. They are hazardous, because ladders are used to board these rides, one risks the danger of falling. GFORS placed in the earth for support, lack the opportunities made available with portability. GFORS built with a one way path, allow for a single orbital direction only.

OBJECTIVES AND ADVANTAGES

Accordingly, several objectives, and advantages of the present invention are:

(a) An objective of the present invention is to provide a GFOR with paths that allow for reversing in rotational directions, as well as in the vertical directions. Thus making a reversing GFOR.

(b) To provide a reversing GFOR with paths that allow for endless orbital travel, up and down the vertical axis, clockwise or counter clockwise.

(c) To provide a reversing GFOR, with paths that enable the passengers to free fall, for added excitement.

(d) To provide a reversing GFOR with a mobile platform for portability.

(e) To provide a reversing GFOR with an enclosed passenger carriage.

(f) To provide a reversing GFOR with a point of no return, starting area

Further objectives and advantages are to provide a GFOR which can be boarded from ground level, without requiting ladders. Still, further objectives and advantages will become apparent from a consideration of the ensuing description and drawings. Where the novel features of the invention, together with additional objectives and advantages thereof, may be more clearly understood from a reading of the following specifications, and by reference to the accompanying drawings form apart thereof, wherein;

BRIEF DESCRIPTION OF THE DRAWINGS

In the drawings, closely related figures have the same number, but different alphabetical suffixes.

REFERENCE NUMERALS IN DRAWINGS

Figure 1:
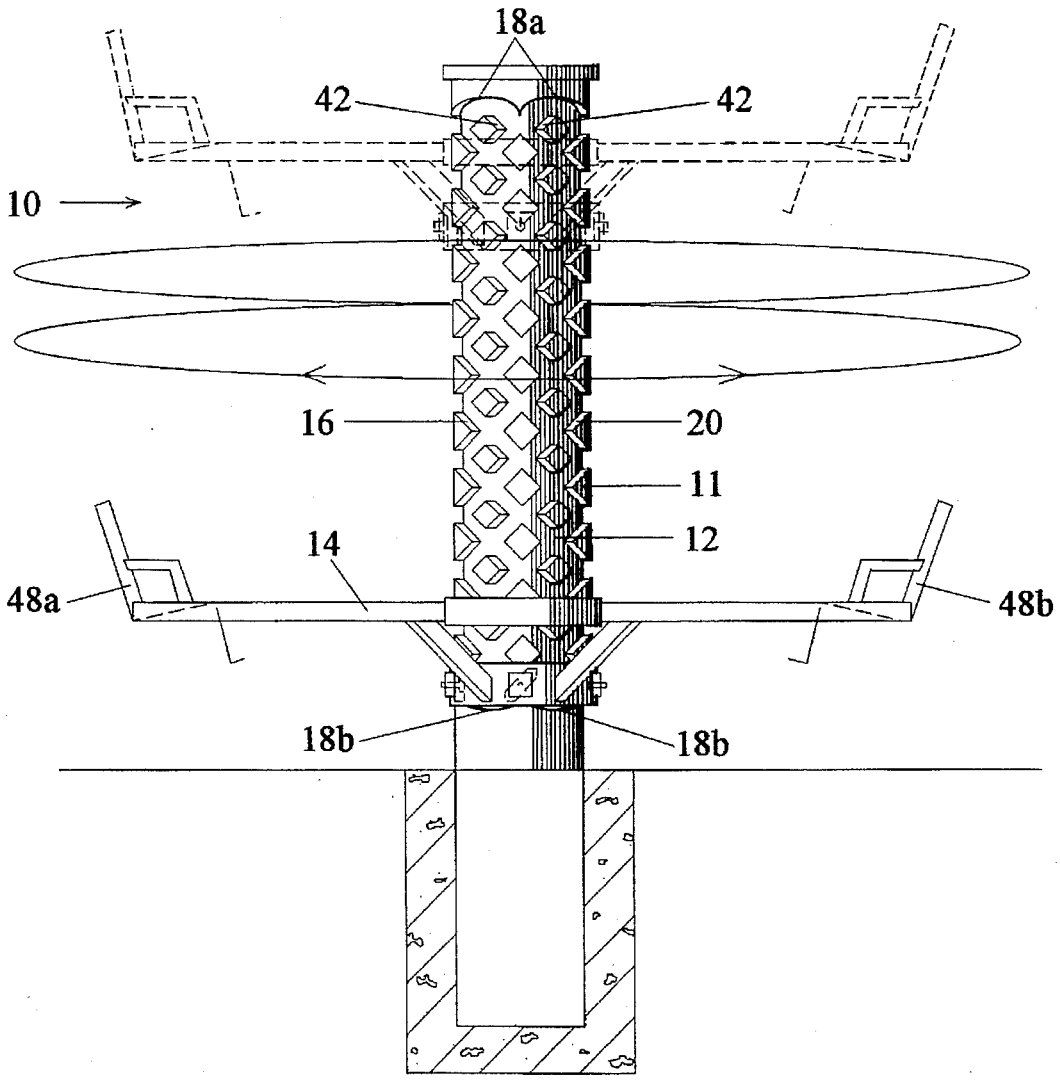
FIG. 1, shows a children's reversing GFOR, with a passenger carriage in an alternate position.

| | | | |
|---|---|---|---|
| 10 | GFOR | 12 | central column |
| 11 | Projections | | |
| 14 a,b | passenger carriages | 16 | counter clockwise (C.C.W.) ascending paths |
| 18 a,b | transition paths | 20 | clockwise (C.W.) ascending paths |
| 22 a,b,c,d | guides | 24 a,b,c,d | axles |
| 26 a,b | stop buttons | 28 a,b,c,d | rotational energy sources |
| 30 | carriage inhibitor | 32 | mobile platform |
| 34 | pole | 36 a,b | rotational energy controllers |
| 38 | sheer pin | 40 | rotable base A |
| 42 | Event Horizon | 44 | vertical paths |
| 46 | vertical support pole | 48 a,b,c,d | seats |
| 50 | V-shaped notch | 52 | bearing |
| 54 | vertical bar | 56 | lever inhibitor |
| 58 | path inhibitor | 60 | rotable base B |
| 62 a,b,c,d | jacks | 64 | ring bearing |
| 66 | motor | | |

DESCRIPTION OF THE PREFERRED EMBODIMENTS

Referring now to the drawings, the figures show a reversing GFOR, generally designated as 10, constructed according to the teachings of the invention. More specifically and with reference to FIG. 1. shown, is a (side view) of a Children's reversing GFOR 10, a central column 12, is vertically supported, by the lower portion being buried in the earth. Column 12 is made of a material suitable to support the weight of multiple passengers and a passenger carriage, such as steel or (PVC) poly vinyl chloride. Column 12 is cylindrical in shape and large enough in diameter, to offer stability to an orbiting passenger carriage. This GFOR is not taller than an average person can reach.

Inclined spiral planes are formed of a material suitable to support the weight of a passenger carriage and multiple passengers, like steel or (PVC), by affixing diamond shaped track projections 11; of a compatible radius, uniformly around the periphery of column 12 in a secure manner, they form an array of (C.W.) ascending paths 20 and (C.C.W.) ascending paths 16, which join together with transition paths 18*a* and 18*b*, on each end of column 12. Upper and lower paths 18*a* and 18*b* are plano-concaved, taking a thirty degree descending angle and gradually curving a radius to a thirty degree ascending angle. Upper paths 18*a* are rotated 180 degrees in relationship to and mirror image those of lower paths 18*b*. One complete path consists of; one path 16, one path 18*a*, one path 18*b* and one path 20. Joining paths 16 and 20 together, forms a multiple of identically shaped closed loop spiral paths. Each path ascends and descends up and down column 12. An Event Horizon 42 is located where paths 16 and paths 20 peak, on the upper end of column 12.

Figure 2A:
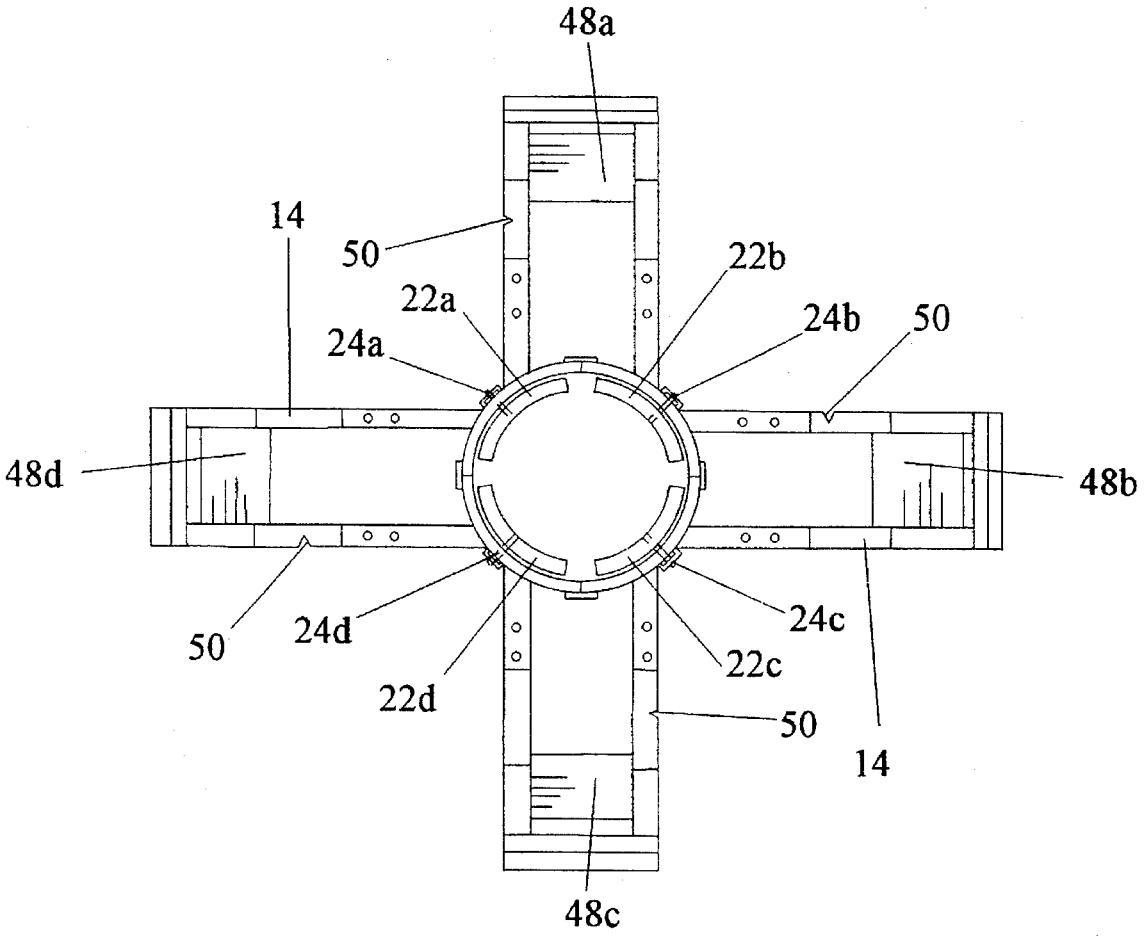
FIGS. 2*a* and 2*b*, shows a passenger carriage, with seats, axles and guides.
Figure 2B:
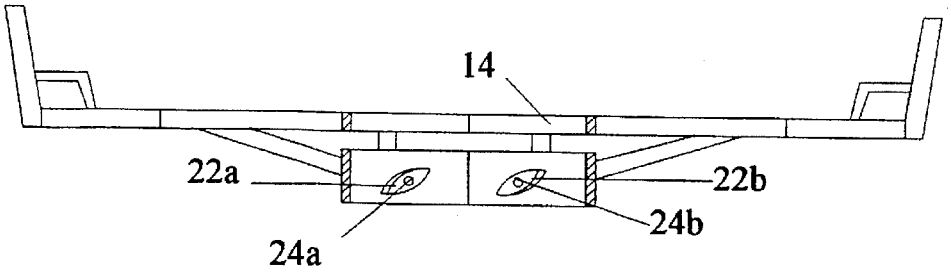
Figure 3A:
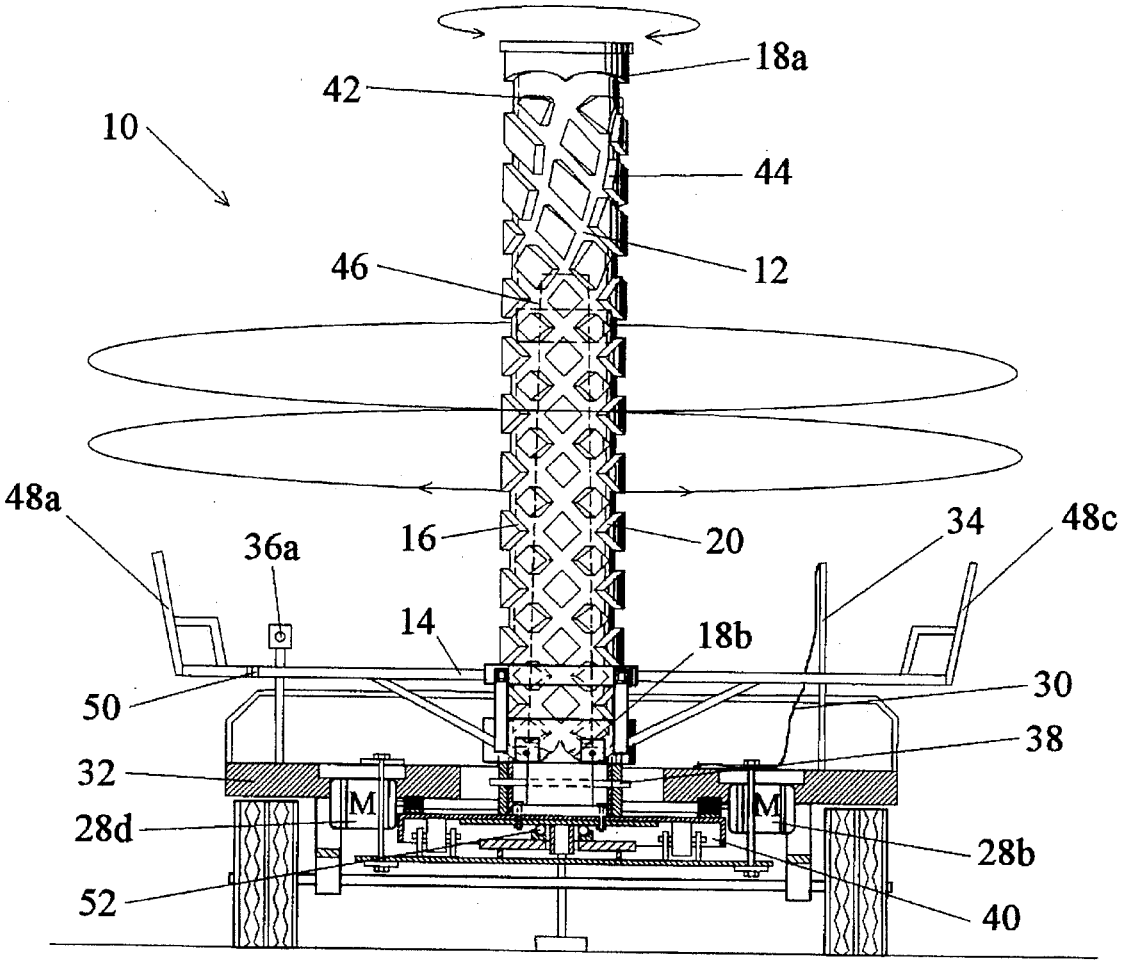
FIGS. 3*a* and 3*b*, shows a preferred embodiment of a reversing GFOR, with rotatable paths, on a mobile platform.

Shown in FIG. 2*a*, (top view) of a passenger carriage 14 made of a material suitable to support the weight of multiple passengers, such as steel. Carriage 14 supports passenger seats 48 *a,b,c* and *d* that attach with a removable pin, (not shown in the drawings), are also adjustable and extend from there outwardly. Seats 48 can be either fixed or dynamically mounted. Looking now at FIG. 2*b*, an (inside view) of two quarter sections of carriage 14, two guides 22*a* and 22*b* can be seen, supported on axles 24*a* and 24*b*. Axles 24 *a,b,c* and *d* have the shape of a straight dowel, with one end cut flat at ninety degrees, made of hardened steel large enough in diameter to support the load of multiple passengers and carriage 14. Axles 24 are rigidly mounted to carriage 14 and supports guides 22 *a,b,c* and *d*. When guides 22 are made in the form of a skid, out of(PVC), the lower side is curved to the same radius as the radius of paths 18*b*. Their length is twice as long, as the distance between any two path pieces and axles 24 are placed in a through hole, located in the center of guides 22. Guides 22 can be made in the form of skids, rollers, wheels or any low friction guidance means, such as Teflon, (TPFF) or (PVC). A V-shaped notch 50 is cut into each carriage seat arm. Referring to FIGS. 1 and 3*a*, a passenger carriage 14, surrounds column 12 and rigidly interlocks guides 22 with the spiral paths, while allowing them to pivot.

Figure 3B:
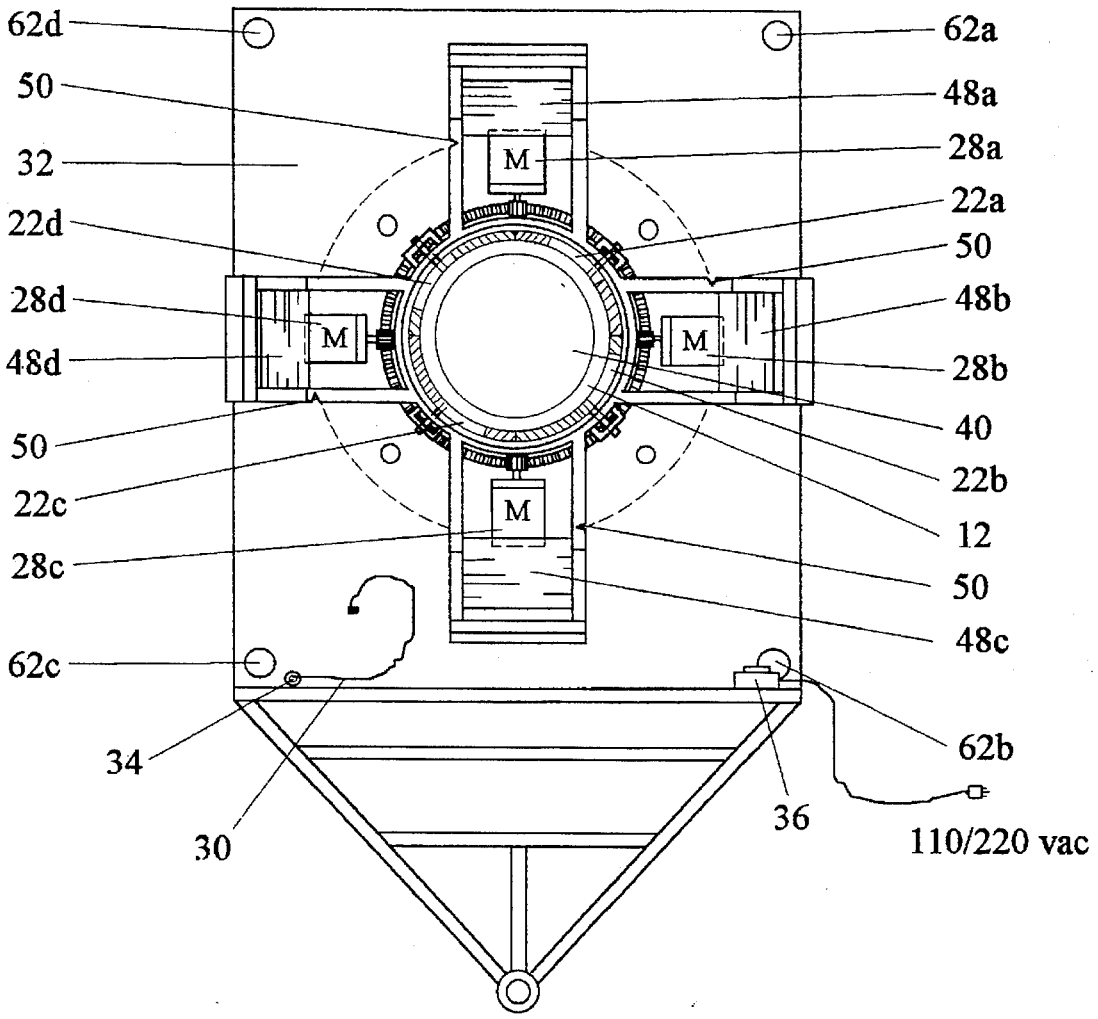

Referring now to FIGS. 3*a* and 3*b*, shown is a (rear view) and a (top view) respectively of a mobile reversing GFOR 10, column 12 is secured to a rotatable base A 40, with a wooden sheer pin 38, that passes through a vertical support pole 46, pole 46 is made of tubular steel and has four mounting holes on it's base. A mobile platform 32 supports base A 40, which is mounted on a bearing 52 and jacks 62*a,b,c* and *d* are located one in each comer.

A carriage inhibitor 30 is a flexible line with an enlarged loose end, one end attaches to pole 34 and the enlarged other end is temporarily held in a V-shaped notch 50, on carriage 14 during a rewind operation and has an automatic release. Also, shown in FIGS. 3*a* and 3*b*, a rotational energy controller 36*a*, is electrically connected to rotational energy sources 28*a,b,c* and *d*. The GFOR of FIG. 3*a* show paths 44 on the upper end of column 12 angling at approximately seventy degrees. To provide paths 44 which are nearly vertical, turns must be taken out or unwound from the descending paths on the upper end of column 12, if paths 18*a* get out of synchronization with 18*b*, four single paths can change to two paths, each being twice as long as one single path or four single paths can become one path, four times longer then a single path and still use the same number of guides 22. Referring now to FIG. 1 and 3*a,a* Event Horizon 42, is located where paths 16 and paths 20 peak.

Figure 4:
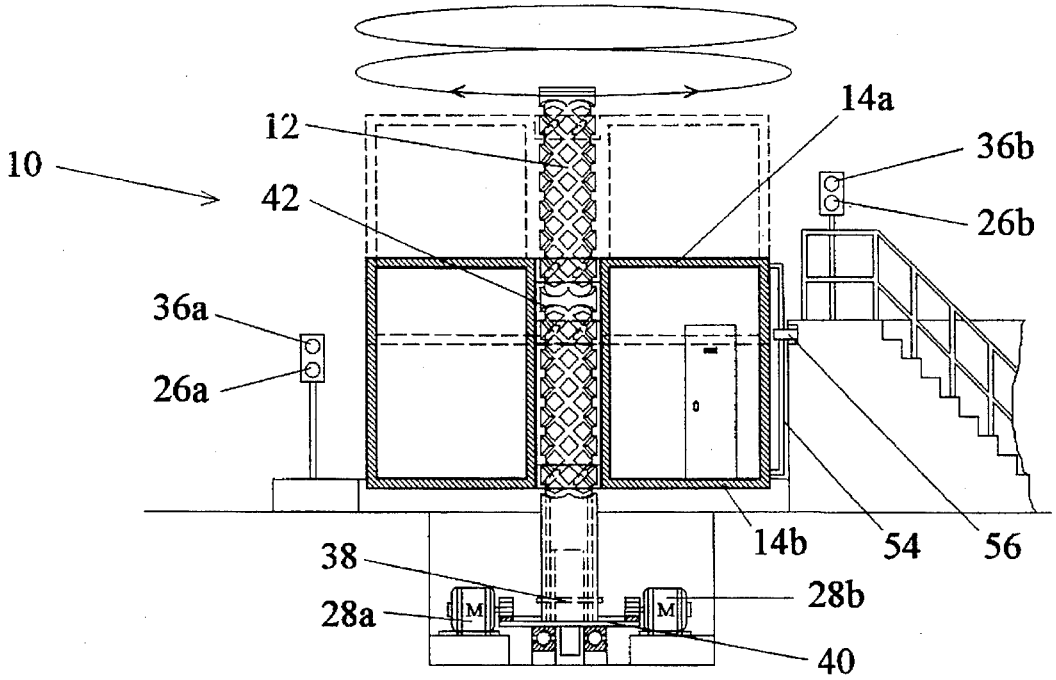
FIG. 4, shows a preferred embodiment of a reversing GFOR, with an enclosed passenger carriage.
Figure 5:
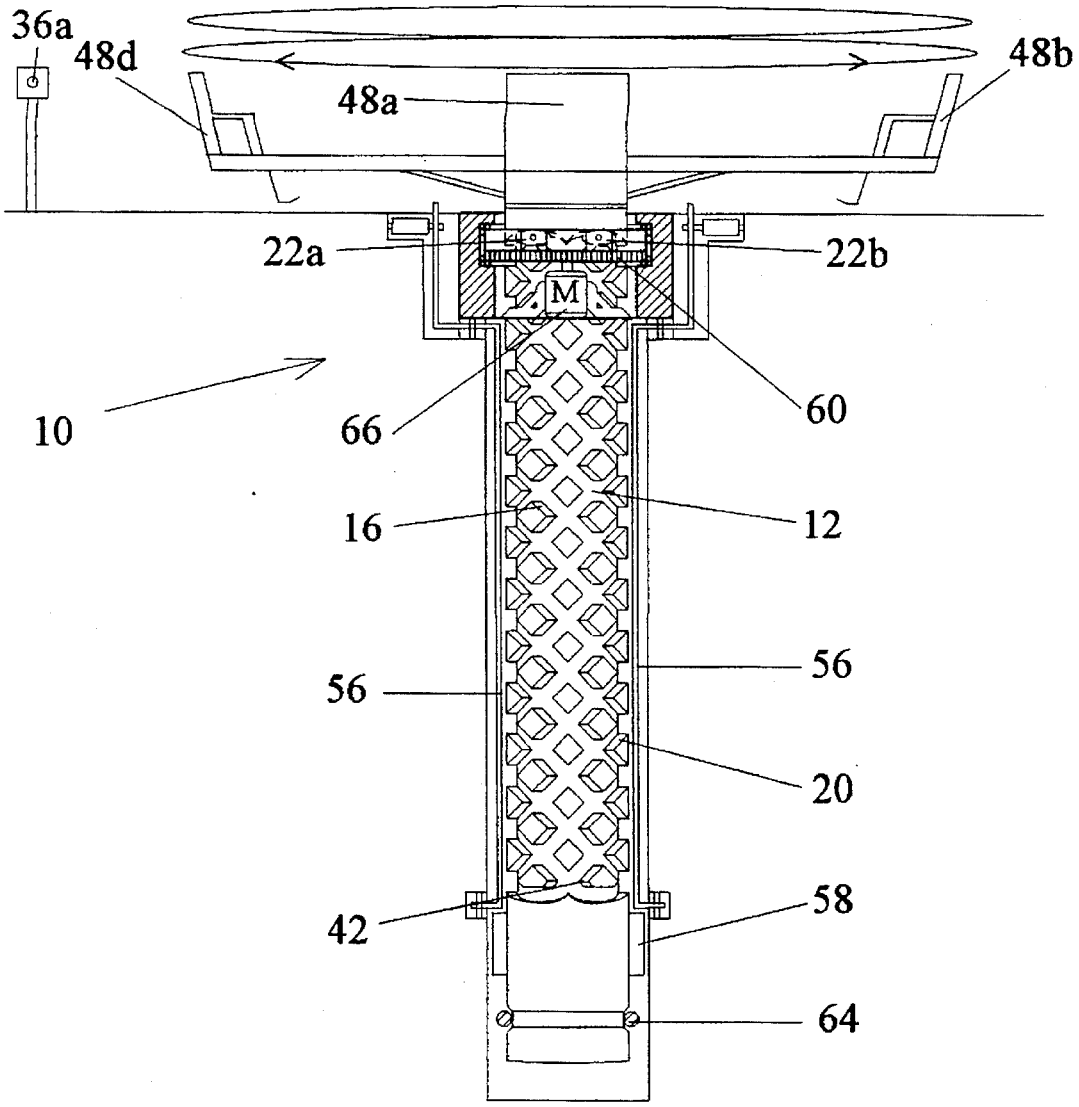
FIG. 5, shows a preferred embodiment of a reversing GFOR, with paths and guides in an optional configuration arrangement.

Referring now to FIG. 4, shown is (side view) of a preferred embodiment of a reversing GFOR 10, using two identical sets of paths, on a single column 12. Upper and lower paths and guides provide stability to carriage 14. To provide a enclosed passenger carriage for standing, two carriages 14*a* and 14*b* are required, by attaching a ceiling to upper carriage 14*a* and a floor to lower carriage 14*b*. The ceiling on carriage 14*a* attaches to the floor on carriage 14*b* with a surrounding vertical wall and a door is also provided. Column 12 is connected with a wooden sheer pin 38, to rotatable base A 40, that is rotationally coupled to rotational energy sources 28*a* and *b*, that are in turn electrically connected to controllers 36*a* and *b*. A lever inhibitor 56 is electrically connected to stop buttons 26*a* and 26*b*. A vertical bar 54, is attached to the periphery of the vertical wall. FIG. 4 shows a Event Horizon 42 located at the upper end of both sets of spiral paths. Referring now to FIG. 5, shown is a (side view) of a reversing GFOR 10, passenger's seats 48 are permanently affixed to the upper end of column 12. Guides 22 pivot on axles 24, located on a rotatable base B 60, that is supported with a concrete foundation. Column 12 is vertically supported on guides 22 and stabilized using a lower ting bearing 64. A path inhibitor 58 is a flexible line secured to the ground and is temporarily attached to carriage 14 during a rewind operation and has an automatic release. Controllers 36 is electrically connected to motor 66. The Event Horizon is located on the lower end of column 12.

From the above description a number of advantages of the present invention become evident.

(a) transition paths provide a GFOR with a way to change, from a descending to a ascending direction while, orbiting clockwise or counter clockwise and visa-versa.

(b) ascending and descending closed loop spiral paths provide a GFOR with endless orbit up and down the vertical axis, either clockwise or counter clockwise.

(c) seventy degree paths provide a reversing GFOR with a free fall, adding new excitement to GFORS.

(d) a mobile platform provides a reversing GFOR with, diversified access to the public and potential riders.

(e) A duplicate set of paths and guides with a surrounding vertical wall provides, a reversing GFOR with an enclosed passenger carriage.

(f) Optional configurations can be made, that provide the same function.

Operation of FIGS. 1, 3*a*, 3*b*, 4 and 5

Referring now to FIG. 1, 3*a*, 4 and 5, the Event Horizon is that point on the paths, where the influence of gravity impels passengers, beyond the point of no return, where the ride starts. When carriage 14 reaches the Event Horizon, it responds to the pull of gravity and begins a descending orbit. Hence the name, "Event Horizon". When a free fall is added, the Event Horizon is approached from the same rotational direction. Referring now to FIG. 1 (side view) of a children's reversing GFOR 10. This GFOR is intended to be used with an adult. Children are placed in seats 48*a* and *b* and walked in circles to the Event Horizon. The adult can spin the children back and forth first, by pushing in one direction and letting the children spin up, then pushing them again on their way back, in the same direction of travel and similar to how a swing goes higher and higher when pushed at the fight time, eventually the children reach the Event Horizon and the ride begins to travel a spiral course, powered by gravity.

Referring to FIG. 3*a* (rear view) and 3*b a* (top view) of a mobile reversing GFOR 10, shown with carriage 14 at rest in paths 18*b*, passengers board the ride, when it is in this position. When the operator observes the passengers are seated properly, in seats 48*a,b,c* and *d*, he then places the enlarged end of inhibitor 30 in notch 50, then activates controller 36*a*, motors 28*a,b,c* and *d*, labeled "M" rotate column 12. Inhibitor 30 being leashed to carriage 14 inhibits it's rotation in one direction only, forcing guides 22 to follow paths 16, elevating carriage 14 vertically to the Event Horizon. At this time the operator deactivates controller 36*a* and column 12 stops rotating. Also at this time, inhibitor 30 is automatically released as carriage 14 rotates beyond it's reach. Thus, carriage 14 is directed by guides 22 down a vertical path or paths 44, where the passengers free fall and experience the sensation of weightlessness. After the weightless drop, carriage 14 gradually changes to a lesser angle of descent, momentum and centrifugal G-Force are still accumulating at a very rapid and steady rate. Passengers continue accelerating until guides 22 reach paths 18, which sends carriage 14 in the ascending orbital direction.

Sheer pin 38 acts as a safety device that allows column 12 to rotate independently of base A 40. If, for any reason the passenger carriage would want to come to a sudden abrupt stop, pin 38 will sheer and the passengers will coast to a stop, along with column 12.

The passengers recover from the influence of intense centrifugal G-Force as carriage 14 continues along an orbital ascent. The passengers slow to a brief stop, change orbital direction and begin another descent, orbiting in the opposite direction. When reaching paths 18*b* they will again, be directed along an ascending orbital path. The course repeats itself until coming to rest, in paths 18*b*. The ride is then over and the passengers depart.

Referring now to FIG. 4 *a* (side view) of a reversing GFOR 10, with an enclosed passenger carriage 14 surrounding column 12. Passengers stand in this GFOR, like they would an elevator, entering from either the ground level or from the next level up. Passengers entering from the upper level, travel to the lower level with the use of gravity, when lever inhibitor 56 is deactivated, using stop button 26*a* or 26*b*. Passengers entering the ride from the lower level can be juggled back and forth, by alternating the rotation of column 12 back and forth, using source 28*a* and *b*, in a rhythmic fashion without applying inhibitor 56, essentially bouncing them to the upper level. They can be elevated directly to the upper level using controller 36*a* or *b* to rotate column 12 and apply inhibitor 56 using stop button 26*a* or 26*b*.

Referring now to FIG. 5 shown is a (side view) of a reversing GFOR 10. Passengers are secured in seats 48. This GFOR is used with inhibitor 58 placed in V-shaped notch 50 and acts to prevent the rotation of column 12, while simultaneously activating motor 66 using controller 36, rotating guides 22 will elevate passengers and column 12, to the Event Horizon, located at the bottom of column 12. Henceforth, the ride takes the passengers down a predetermined course defined by the paths.

SUMMARY OF THE INVENTION

Accordingly, the reader will see that the reversing GFOR of the present invention is a complete and truly unique GFOR. Paths allow for continued orbital rotation up and down the vertical axis. A motorized column of endless loop paths used with a rotary inhibitor enables passengers to load and unload from ground level and be elevated to the Event Horizon, eliminating the need for ladders, thus providing a GFOR that can be used in a much safer manner by the public. Weightlessness can be experienced and an intense centrifugal G-Force sensation in either the standing or sitting position on static or dynamically mounted seats on either a permanently installed or a relocatable mobile platform. Furthermore, the GFOR of the present invention has additional advantages in that:

* lower transition paths allow a passenger carriage to reverse in vertical directions during maximum orbital velocity;
* closed loop spiral paths provide a reversing GFOR with endless orbital travel up and down the vertical axis;
* vertical paths provide a GFOR whereby passengers can experience the sensation of weightlessness;
* upper transition paths provide an Event Horizon, point of no return, starting area;
* a mobile platform enables a GFOR to access a variety of locations;
* a duplicate set of paths and guides can be configured to provide a reversing GFOR with an enclosed passenger carriage to be used in the standing position;
* a reversing GFOR has the diversity of optional configurations that produce the same effects;
* a reversing GFOR with rotatable closed loop spiral paths, used with a rotary inhibitor, eliminates the need for ladders.

The realm of the present invention should not be limited, except to encompass and include, variations in sizes and dimensions along with combinations of various other arrangements and configurations, for the passengers can be located on either the outer or the inner structure, for as one structure is held stationary the other, follows a predetermined course that produces a continuous down and up spiraling motion.

Therefore, the scope of the present invention should be determined by the appending claims and their legal equivalence, rather than by the examples given.

What is claimed is:

1. A reversing gravity fed orbital ride, comprising:

a central column, a plurality of projections projecting from said central column defining a plurality of paths, each said path is a closed loop, each said path is a spiral, each said path inclines and declines whereby, a descending orbit is changed to an ascending orbit and visa-versa;

a plurality, of guidance means, attached to a passenger carriage, said passenger carriage supports a plurality of passenger seats, each said guidance means is interlocked with each said path, enabling gravity to pull said passenger carriage into an orbital ascent.

2. The ride of claim 1 further including a rotational energy means, for rotating said paths.

3. The ride of claim 2 further including a inhibiting means whereby preventing said passenger carriage from rotating in one orbital direction.

4. The ride of claim 3 further including, a mobile platform for portability.

5. The ride of claim 4 wherein said paths are nearly vertical, whereby passengers can experience weightlessness.

6. The ride of claim 3 further including, a second plurality of projections of said paths, and a second said passenger carriage, and said guidance means, placed on top of previous said central column, used in conjunction with previous said central column, previous said paths, previous said passenger carriage, and previous said guidance means, where said passenger carriages are located one above the other and connect together at the periphery of said passenger carriages, with a surrounding vertical wall, whereby providing an enclosed passenger carriage, wherein passengers ride in the standing position.

7. A reversing gravity fed orbital ride, comprising:

A central column, a plurality of projections projecting from said central column defining a plurality of paths, each said path inclines and declines, each said path is a closed loop, a plurality of passenger seats are affixed to said paths;

a plurality of guidance means attached to a rotatable base, each said guidance means interlocks with each said path, allowing said path to follow said guidance means;

a rotational energy means for rotating said guidance means;

a inhibiting means applied to said passenger carriage whereby preventing said passenger carriage from rotating in one orbital direction.

8. A gravitational means for accelerating humans in an orbital ascent, comprising:

A central column, a plurality of projections projecting from said central column defining a plurality of paths, each said path is a closed loop, each said path is a spiral, each said path inclines and declines whereby, a descending orbit is changed to an ascending orbit and visa-versa;

a plurality of guidance means, attached to a passenger carriage, said passenger carriage supports a plurality of passenger seats, each said guidance means is interlocked with each said path, enabling gravity to pull said passenger carriage into an orbital ascent;

a rotational energy means, for rotating said paths;

a inhibiting means whereby preventing said passenger carriage from rotating in one orbital direction.

* * * * *